US005320275A

United States Patent [19]

Williams

[11] Patent Number: 5,320,275

[45] Date of Patent: Jun. 14, 1994

[54] MULTIPLE USE BUSINESS PORTFOLIO

[76] Inventor: Mary L. Williams, 903 Deerfield, Midland, Mich. 48640

[21] Appl. No.: 36,282

[22] Filed: Mar. 24, 1993

[51] Int. Cl.[5] ..... B65D 27/08

[52] U.S. Cl. ..... 229/1.5 R; 229/72

[58] Field of Search ..... 229/1.5 R, 72

[56] References Cited

U.S. PATENT DOCUMENTS

| | | | |
|---|---|---|---|
| 868,835 | 10/1907 | Bexell | 229/1.5 R |
| 1,168,634 | 1/1916 | Hoffman . | |
| 1,378,959 | 5/1921 | Holt | 229/1.5 R |
| 2,810,511 | 10/1957 | Cantor . | |
| 3,154,125 | 10/1964 | Harvey | 229/1.5 R |
| 3,288,352 | 11/1966 | Dwork . | |
| 3,312,384 | 4/1967 | Heynemann . | |
| 3,399,824 | 9/1968 | Dodge . | |
| 4,301,962 | 11/1981 | Monckton et al. | 229/1.5 R X |
| 4,549,688 | 10/1985 | Ozmon et al. | 229/1.5 R |
| 4,991,767 | 2/1991 | Wyant . | |

*Primary Examiner*—Allan N. Shoop
*Assistant Examiner*—Jes F. Pascua
*Attorney, Agent, or Firm*—Robert L. McKellar

[57] ABSTRACT

This invention deals with a novel multiple use business portfolio for use in storing and safely transporting documents, papers, cards, writing materials, which portfolio is also convenient.

1 Claim, 1 Drawing Sheet

MULTIPLE USE BUSINESS PORTFOLIO

This invention deals with a a novel multiple use business portfolio for use in storing and safely transporting documents, papers, cards, writing materials, and the like, which is also convenient.

There are numerous portfolios for storing and carrying business papers on the market today. However, these portfolios are particularly adapted to very limited uses and cannot be used conveniently for multi-purpose uses. The portfolio of the instant invention has as its functional utility, the ability to provide convenient multi-purpose uses all in the same portfolio.

More specifically, a portfolio is provided which allows for the organization of, and the carrying of, a multitude of various documents, papers, cards, writing materials and other like materials in the same carrying case while maintaining the privacy of the materials, and without the need to carry several different cases.

FIELD OF THE INVENTION

The portfolios of the instant invention are new and novel. No other portfolio known to the inventor herein can provide the convenience of the portfolio of the instant invention.

In the real estate business, for example, an individual who wishes to purchase real estate is provided with a multitude of printed materials such as brochures, business cards, banking information, builder information, school information, landscaping information, and the like, all of which does not have the same overall dimensions, bulk or use. Thus, when all of this material is provided to the real estate buyer, there is no convenient way to organize and store such information. Typically, the portfolios provided by real estate firms are not multi-functional. For example, one may provide an accordion file which can contain various standard size brochures and other papers, but is very inconvenient for storing business cards, which fall to the bottom of the file, or worse yet, are lost entirely from the accordion file because they were not appropriately held safely in the file. On the other hand, one can provide a portfolio which will accomodate business cards, but there is very limited space for storing standard business documents, and quite often, there are not enough pockets to provide organizational capabilities for the documents.

Further, for some transactions, such as real estate transactions, privacy for the buyer is not only desired, but is normally required and the buyer must therefore have the ability to maintain in privacy the various documents, and the like, associated with the real estate transaction.

Still further, the real estate agent is interested in providing clients with portfolios that contain thereon, some advertising or other indication of the firm that they are working with and thus, it is desirable to have the front of the portfolio provided with the firm name, or some other such advertising means.

There are numerous envelopes, portfolios, expanding files, and covers available in the prior art. Some such materials are disclosed for example in U.S. Pat. No. 1,168,634, issued on Jan. 18, 1916 to Hoffman, which shows and illustrates a coupon register, which is of a tri-fold construction, and which contains small pockets for the insertion of coupons. When the register is folded together, the coupons are protected and will not escape from the register.

The U.S. Pat. No. 2,810,511 to Cantor, which issued on Oct. 22. 1957, describes an envelope which appears to have expandable side portions. The essence of the disclosure therein is the fastening device for the folder, which is constituted of an elastic rubber band having its fixed point inside the overflap of the envelope.

U.S. Pat. No. 3,288,352, issued on Nov. 29, 1966 to Dwork, and U.S. Pat. No. 3,312,384, issued on Apr. 4, 1967 to Heynemann, both deal with an expanding file-folder construction, wherein in Dwork, the essence of the invention is the elastic tie, and wherein in Heynemann, the essence of the invention is the use of end loops to allow the easy removal of the file-folder from a storage file.

U.S. Pat. No. 3,399,824, issued Sep. 3, 1968, to Dodge, deals with a card holder which is a tetra-fold envelope containing on the inside of the back, a series of pockets to hold business cards and the like.

U.S. Pat. No. 4,991,767, issued Feb. 12, 1991, to Wyant, deals with a portfolio which is used to store photographs, but which has a display cover which allows one to view the photographs stored therein without opening the portfolio.

None of the prior art materials anticipate the instant invention nor does any combination of them suggest the utility, privacy, and convenience of the instant invention portfolio.

The improved portfolio of the instant invention provides for all of the above-mentioned multiple needs in one portfolio and makes it convenient for the user to organize various documents, business cards and the like in one convenient carrying case with the ability to maintain all of it in privacy.

THE INVENTION

This invention is thus directed to a multi-purpose portfolio for storing and transporting a variety of materials such as papers, brochures, booklets, business cards, writing materials and the like, in privacy, and with safety from loss of the materials carried therein.

Thus, the instant invention deals with a portfolio having a front side with top and bottom edges, and a back side having top and bottom edges, wherein the front side and back side are joined together by gusseted ends, and a gusseted bottom. In addition, the portfolio has an open top leading to the interior. The back side has a flap fixed to its top edge, and the flap has a front surface and a back surface. The flap overlaps the front side when covering the open top and closes the portfolio.

In addition, the flap has an endless elastic band attached through its front surface and the band is capable of encircling the portfolio when the portfolio is closed. The portfolio has at least one vertical separation wall in its interior to separate contents placed therein and each said separation wall has a top edge and an overall size commensurate with the front side of the portfolio, wherein at least one of the separation walls has fixed on it at least one tab which may or may not be pre-inscribed. The flap has fixed to its front surface at least one transparent insert receiving pocket and the flap has fixed to its back surface a plurality of transparent insert receiving pockets.

The front side of the portfolio has fixed on it at least one transparent insert receiving pocket. The front side of the portfolio has a short horizontal slit through it, which is dislocated from any insert receiving pocket located on the front side of the portfolio. The portfolio when closed is capable of containing and maintaining a variety of information in privacy.

DETAILED DESCRIPTION OF THE DRAWINGS

Figure 1:
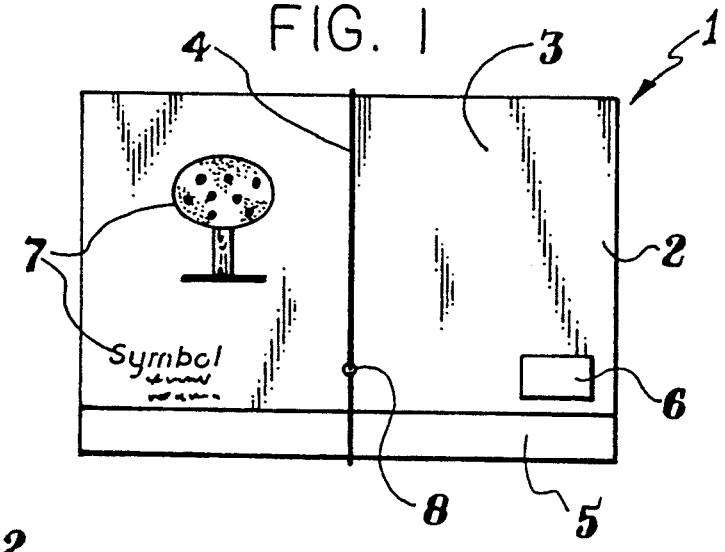
FIG. 1 is a front view of the portfolio in the closed position with an elastic tie band in place.

With reference to FIG. 1, there is shown a front view of a closed portfolio 1 of this invention. The portfolio has a front side 5 with top 16 and bottom 17 edges and the front side 5 and the back side 18 are joined together by gusseted ends (accordion style) 9. The portfolio 1 has an open top 19 leading to the interior of the portfolio. There is shown affixed to the back side 18, a flap 2 having a front surface 3 and a back surface 21. Also shown is an endless elastic band 4 attached to and through the front surface 3, a small portion of the front surface 5 of the portfolio, and a transparent insert receiving pocket 6. The endless elastic band 4 is capable of encircling the portfolio when the portfolio is in the closed position. The transparent receiving pocket 6 is used generally to hold a business card or the like to identify the owner of the portfolio. In one embodiment of this invention, there is shown symbols 7 which symbols can be used to advertise the business of the provider of the portfolio 1, but such embodiment is not critical to the novelty of the invention. A tie down point 8 for the elastic band 4 is shown on the flap 2, near the bottom.

Figure 2:
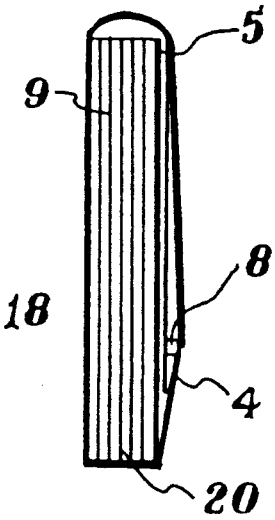
FIG. 2 is an end view of the portfolio showing the accordion configuration of the ends.

FIG. 2 is an end view of the portfolio 1 of FIG. 1, in the closed position, in which there is shown one of the gusseted ends 9 of the portfolio, it being understood that the opposite end of the portfolio is configured in the same manner. The gusseted ends are securely attached to the side edges of the front 5 and back 18 of the portfolio 1, along with a bottom 20 to afford an envelope configuration for the portfolio 1. What is shown as the gusseted ends 9 is an accordian configuration, which allows the portfolio 1 to be expanded when materials are placed into the interior of the portfolio. There is also shown in this Figure for the sake of clarity, is the elastic band 4 and the tie down point 8.

Figure 3:
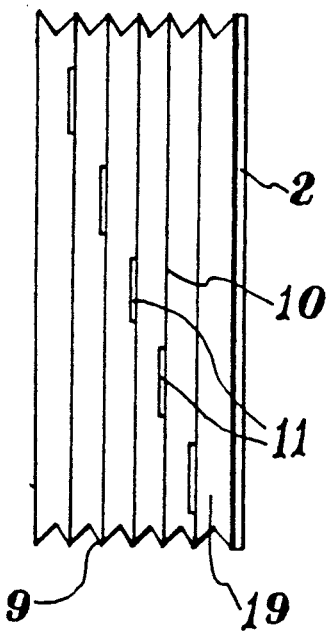
FIG. 3 is a top view of the opened portfolio, showing the flap folded back over the back surface of the portfolio and it also shows the interior of the portfolio and the vertical separations located therein, with tabs.

FIG. 3 shows a top view of the portfolio in the open position with the flap 2 folded along the back surface (not shown) of the portfolio. FIG. 3 thus shows the approximate placement of the vertical separation walls 10 of the portfolio in the interior as well as the accordion configuration of the ends 9 of the portfolio. The vertical separation walls 10 in the interior have a top edge and an overall size commensurate with the front side of the portfolio. Also shown are tabs 11 on the individual vertical separation walls 10, and in FIG. 4, there is illustrated a partial front view of the portfolio which shows the tabs 11 arranged in order so that they can be viewed from the front of the portfolio. It should be understood by those skilled in the art that not all of the vertical separation walls 10 need to have an identifying tab 11.

Figure 4:
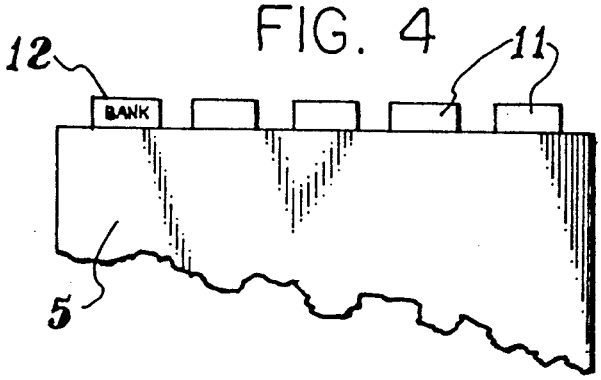
FIG. 4 is a partial view of the front of the portfolio, showing tabs organized along the upper edges of the vertical separations in the interior of the portfolio.

In FIG. 4, one such tab, for example, has the designation "bank" at point 12. In practice, all of the rest of the tabs 11 could be blank, that is, they do not necessarily need to contain any identification.

Figure 5:
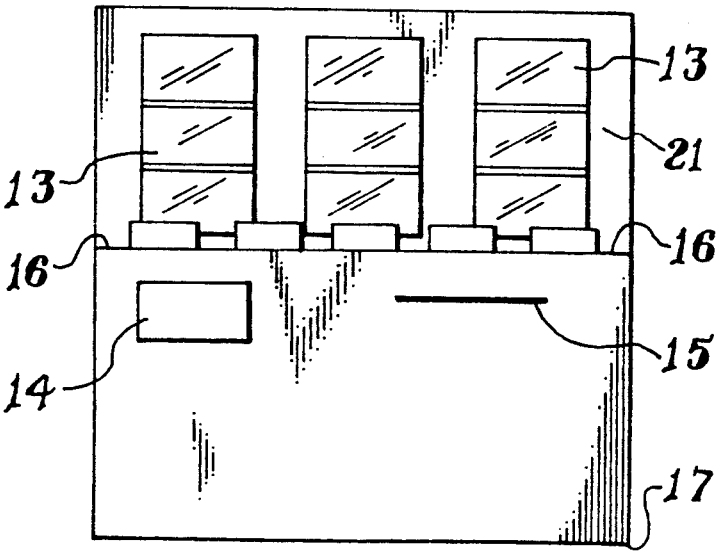
FIG. 5 is a full front view of the portfolio showing the flap in an open position with transparent card pockets mounted on the flap's interior surface.

With reference to FIG. 5, one can observe the tabs 11 in order. FIG. 5 also shows the inside surface of the flap 2, wherein there is mounted transparent insert receiving pockets 13 for business cards. Preferably, the two outside rows of these pockets should have their open ends facing inwardly so as to prevent the escape of business cards, when the portfolio is closed and is being handled, although, it is not critial for this invention that the receiving pockets 13 be so situated.

Also mounted on the upper edge of the front surface 5 of the portofilio 1 is a transparent insert receiving pocket 14, which is used to hold a business card or the like to identify the agent or trustee who is handling the transaction. In other words, this pocket is used to hold the business card or the like of the person who is coordinating the entire activity of the portfolio holder.

Finally, there is shown in FIG. 5, a horizontal slit 15 which can be used to hold a writing tablet or the like. This slit 15 is generally long enough to accomodate the hard back cover of a writing tablet or the like and when the back cover is inserted into the slit 15, the tablet (not shown) is on the surface of the portfolio, when open, so that it can be used for transcribing notes and the like.

In use, the agent, or the coordinator of the business activity supplies the prospect or customer with a portfolio of this nature. The portfolio is equipped with a business card or the like in pocket 6 to identify the user. A card, representing the agent or coordinator is also placed in the pocket 14. A tablet is also placed in the slit 15 and the tabs 12 are pre-identified with inserts, or are left blank for the use of the holder of the portfolio. As the transaction evolves, the holder of the portfolio collects various items associated with the transaction and inserts letters, brochures, data sheets and the like into the vertical separation walls with the appropriately marked tabs, and the business cards that are collected are placed into the pockets 13. When the portfolio is required to be transported, the flap 2 is closed over the front surface 5 of the portfolio 1 and the elastic band 4 is placed such that it encircles the portfolio 1 and holds the flap 2 secure.

When it is desired to add to the materials in the portfolio 1, the elastic band 4 is removed, the flap 2 is opened and all of the contents of the portfolio are immediately visible to the user. Thus, the user can extract materials from the portfolio, or add materials to the portfolio without undue hardship. Once the portfolio is closed and the elastic band 4 encircles it, the contents are essentially safe from loss and are private.

As mentioned supra, the front of the flap 2 can be embossed, printed, painted, or otherwise decorated to advertise the company or business that is utilizing the portfolio. The portfolio can also be colored or color shaded to accomodate the advertising of the business, or it can be black or white or shades of white or color.

Thus, the utility of the inventive portfolio can be easily observed from the above description.

What is claimed is:

1. A portfolio having a front side with top and bottom edges, and a back side having top and bottom edges, said front side and back side being joined together by gusseted ends, and a gusseted bottom, said portfolio having an open top leading to the interior thereof; said back side having a flap fixed to its top edge, said flap having a front surface and a back surface, said flap overlapping said front side when covering the open top and closing said portfolio; said flap having an endless elastic band attached through its front surface, said band being capable of encircling said portfolio when the portfolio is closed;

said portfolio having at least one vertical separation wall in its interior to separate contents placed therein; each said separation wall having a top edge, and an overall size commensurate with the front side of the portfolio, wherein at least one of such separation walls has fixed thereon at least one tab for receiving indicia;

said flap having fixed to its front surface at least one transparent insert receiving pocket:

said flap having fixed to its back surface a plurality of transparent insert receiving pockets;

said front side of said portfolio having fixed thereon at least one transparent insert receiving pocket;

said front side of said portfolio having a short horizontal slit therethrough which is dislocated from any insert receiving pocket located thereon;

said portfolio when closed, being capable of containing and maintaining a variety of information in privacy.

* * * * *